US010364632B2

(12) United States Patent
Xu et al.

(10) Patent No.: US 10,364,632 B2
(45) **Date of Patent: *Jul. 30, 2019**

(54) DOWNHOLE ASSEMBLY INCLUDING DEGRADABLE-ON-DEMAND MATERIAL AND METHOD TO DEGRADE DOWNHOLE TOOL

(71) Applicants: Zhiyue Xu, Cypress, TX (US); James Doane, Friendswood, TX (US); Yingqing Xu, Tomball, TX (US); Zhihui Zhang, Katy, TX (US)

(72) Inventors: Zhiyue Xu, Cypress, TX (US); James Doane, Friendswood, TX (US); Yingqing Xu, Tomball, TX (US); Zhihui Zhang, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 103 days.

This patent is subject to a terminal disclaimer.

(21) Appl. No.: 15/599,081

(22) Filed: May 18, 2017

(65) Prior Publication Data

US 2018/0171738 A1 Jun. 21, 2018

Related U.S. Application Data

(63) Continuation-in-part of application No. 15/385,021, filed on Dec. 20, 2016.

(51) Int. Cl.
*E21B 29/02* (2006.01)
*E21B 47/06* (2012.01)
(Continued)

(52) U.S. Cl.
CPC ..... *E21B 29/02* (2013.01); *E21B 33/12* (2013.01); *E21B 34/06* (2013.01); *E21B 43/116* (2013.01);
(Continued)

(58) Field of Classification Search
CPC ..... E21B 29/02; E21B 31/002; F42D 1/045; F42D 1/04
See application file for complete search history.

(56) References Cited

U.S. PATENT DOCUMENTS 6,253,843 B1 7/2001 Rawson et al.
7,270,191 B2 9/2007 Drummond et al.
(Continued)

FOREIGN PATENT DOCUMENTS

WO 2013022635 A2 2/2013

OTHER PUBLICATIONS

"Spectre Disintegrating Frac Plug", Baker Hughes, 2015, 8 Pages.
(Continued)

*Primary Examiner* — Kenneth L Thompson
(74) *Attorney, Agent, or Firm* — Cantor Colburn LLP

(57) ABSTRACT

A downhole assembly arranged within a borehole includes a downhole tool including a degradable-on-demand material, the degradable-on-demand material including: a matrix material; and, an energetic material configured to generate energy upon activation to facilitate the degradation of the downhole tool; and, a triggering system including: an electrical circuit; an igniter in the electrical circuit arranged to ignite the energetic material; a sensor configured to sense a target event or parameter within the borehole; and, a control unit arranged to receive sensed signals from the sensor and to deliver a start signal to the electrical circuit in response to the sensed signals indicating an occurrence of the target event or parameter; wherein, after the start signal is delivered from the control unit, the electrical circuit is closed and the igniter is initiated.

29 Claims, 14 Drawing Sheets

(51) Int. Cl.

| | |
|---|---|
| ***E21B 47/00*** | (2012.01) |
| ***E21B 47/18*** | (2012.01) |
| ***E21B 47/12*** | (2012.01) |
| ***E21B 33/12*** | (2006.01) |
| ***E21B 34/06*** | (2006.01) |
| ***E21B 43/116*** | (2006.01) |
| ***E21B 43/1185*** | (2006.01) |
| *E21B 34/00* | (2006.01) |
| *E21B 43/26* | (2006.01) |

(52) U.S. Cl.

CPC ..... *E21B 43/1185* (2013.01); *E21B 47/00* (2013.01); *E21B 47/06* (2013.01); *E21B 47/122* (2013.01); *E21B 47/124* (2013.01); *E21B 47/18* (2013.01); *E21B 43/26* (2013.01); *E21B 2034/005* (2013.01)

(56) References Cited

U.S. PATENT DOCUMENTS

| | | | | |
|---|---|---|---|---|
| 8,056,638 | B2 | 11/2011 | Clayton et al. | |
| 8,235,102 | B1 | 8/2012 | Robertson | |
| 8,256,521 | B2 | 9/2012 | Swor et al. | |
| 8,272,446 | B2 | 9/2012 | Swor et al. | |
| 8,291,969 | B2 | 10/2012 | Swor et al. | |
| 8,291,970 | B2 | 10/2012 | Swor et al. | |
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,485,265 | B2 | 7/2013 | Marya et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,267,347 | B2 | 2/2016 | Agrawal et al. | |
| 9,656,926 | B1 * | 5/2017 | Thoma | E21B 33/12 |
| 9,689,247 | B2 | 6/2017 | Holder et al. | |
| 2007/0209802 | A1 | 9/2007 | Xu et al. | |
| 2013/0062055 | A1 * | 3/2013 | Tolman | E21B 23/00 166/250.01 |
| 2013/0081825 | A1 * | 4/2013 | Lynde | E21B 23/00 166/376 |
| 2013/0118805 | A1 * | 5/2013 | Moody-Stuart | E21B 43/117 175/2 |
| 2013/0160992 | A1 | 6/2013 | Agrawal et al. | |
| 2014/0014339 | A1 | 1/2014 | O'Malley et al. | |
| 2014/0190685 | A1 | 7/2014 | Frazier et al. | |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0345878 | A1 * | 11/2014 | Murphree | C09K 8/703 166/377 |
| 2014/0363692 | A1 | 12/2014 | Marya et al. | |
| 2015/0021023 | A1 | 1/2015 | Roberts et al. | |
| 2015/0027723 | A1 | 1/2015 | Fripp et al. | |
| 2015/0159468 | A1 | 6/2015 | Mailand | |
| 2015/0190984 | A1 | 7/2015 | Zhang et al. | |
| 2015/0239795 | A1 | 8/2015 | Doud et al. | |
| 2015/0259263 | A1 | 9/2015 | Sherman et al. | |
| 2015/0292288 | A1 | 10/2015 | Kasperski et al. | |
| 2016/0130906 | A1 | 5/2016 | Garvey et al. | |
| 2016/0186044 | A1 | 6/2016 | Rothrock et al. | |
| 2016/0209391 | A1 | 7/2016 | Zhang et al. | |
| 2016/0333668 | A1 | 11/2016 | Xu et al. | |
| 2017/0009563 | A1 | 1/2017 | Holder | |
| 2017/0138169 | A1 | 5/2017 | Bogdan et al. | |
| 2017/0218722 | A1 | 8/2017 | Gordon et al. | |
| 2018/0171736 | A1 | 6/2018 | Xu et al. | |
| 2018/0171737 | A1 | 6/2018 | Xu et al. | |
| 2018/0171757 | A1 | 6/2018 | Xu | |
| 2018/0230769 | A1 | 8/2018 | Xu et al. | |
| 2018/0230770 | A1 | 8/2018 | Oag et al. | |
| 2018/0245448 | A1 | 8/2018 | Fripp et al. | |
| 2018/0252070 | A1 | 9/2018 | Zhu et al. | |
| 2018/0283119 | A1 | 10/2018 | Zhang et al. | |
| 2018/0283121 | A1 * | 10/2018 | Zhang | E21B 29/02 |
| 2018/0283141 | A1 * | 10/2018 | Zhang | E21B 41/0085 |
| 2018/0283142 | A1 * | 10/2018 | Zhang | E21B 41/0085 |
| 2018/0334873 | A1 | 11/2018 | Marya | |

OTHER PUBLICATIONS

Huang et al. "Construction and Properties of Structure- and Size-controlled Micro/nano-Energetic Materials", Defence Technology 9 (2013) 59-79.

International Search Report for International Application No. PCT/US2017/062278, dated Mar. 8, 2018, 7 pages.

Written Opinion of the International Search Report for International Application No. PCT/US2017/062278, dated Mar. 8, 2018, 11 pages.

* cited by examiner

DOWNHOLE ASSEMBLY INCLUDING DEGRADABLE-ON-DEMAND MATERIAL AND METHOD TO DEGRADE DOWNHOLE TOOL

CROSS REFERENCE TO RELATED APPLICATIONS

The present application is a continuation-in-part of U.S. patent application Ser. No. 15/385,021, filed Dec. 20, 2016, which is hereby incorporated by reference in its entirety.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating or interventionless downhole tools have been developed. Instead of milling or drilling operations, these tools can be removed by dissolution of engineering materials using various wellbore fluids. Because downhole tools are often subject to high pressures, a disintegrable material with a high mechanical strength is often required to ensure the integrity of the downhole tools. In addition, the material must have minimal disintegration initially so that the dimension and pressure integrities of the tools are maintained during tool service. Ideally the material can disintegrate rapidly after the tool function is complete because the sooner the material disintegrates, the quicker the well can be put on production.

One challenge for the self-disintegrating or interventionless downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period and the change of tool dimensions during disintegration can cause difficulties in well operations and planning. An uncontrolled disintegration can also delay well productions. Therefore, the development of downhole tools that have minimal or no disintegration during the service of the tools so that they have the mechanical properties necessary to perform their intended function and then rapidly disintegrate in response to a customer command is very desirable. It would be a further advantage if such tools can also detect real time tool disintegration status and well conditions such as temperature, pressure, and tool position for tool operations and control.

BRIEF DESCRIPTION

A downhole assembly arranged within a borehole includes a downhole tool including a degradable-on-demand material, the degradable-on-demand material including: a matrix material; and, an energetic material configured to generate energy upon activation to facilitate the degradation of the downhole tool; and, a triggering system including: an electrical circuit; an igniter in the electrical circuit arranged to ignite the energetic material; a sensor configured to sense a target event or parameter within the borehole; and, a control unit arranged to receive sensed signals from the sensor and to deliver a start signal to the electrical circuit in response to the sensed signals indicating an occurrence of the target event or parameter; wherein, after the start signal is delivered from the control unit, the electrical circuit is closed and the igniter is initiated.

A method of controllably removing a downhole tool of a downhole assembly, the downhole tool including a degradable-on-demand material having a matrix material and an energetic material configured to generate energy upon activation to facilitate the degradation of the downhole tool; and, a triggering system including: an electrical circuit; an igniter in the electrical circuit arranged to ignite the energetic material; a sensor configured to sense a target event or parameter within the borehole; and, a control unit arranged to receive sensed signals from the sensor and to deliver a start signal to the electrical circuit in response to the sensed signals indicating an occurrence of the target event or parameter; the method including disposing the downhole assembly in a downhole environment; sensing a downhole event or parameter with the sensor, the sensor sending sensed signals to the control unit; comparing the sensed signals to the threshold value, and when the threshold value is reached, sending the start signal to the electrical circuit; closing the electrical circuit after the start signal is sent; initiating the igniter when the electrical circuit is closed; activating the energetic material using the igniter; and degrading the downhole tool.

BRIEF DESCRIPTION OF THE DRAWINGS

The following descriptions should not be considered limiting in any way. With reference to the accompanying drawings, like elements are numbered alike:

FIG. 6A illustrates a downhole article before activation; FIG. 6B illustrates the downhole article of FIG. 6A after activation; FIG. 6C illustrates an energetic material broken from the activated downhole article of FIG. 6B; FIG. 6D illustrates a matrix material broken from the activated downhole article of FIG. 6B; FIG. 6E illustrates a sensor material broken from the activated downhole article of FIG. 6B; and FIG. 6F illustrates a powder generated from the activated downhole article of FIG. 6B;

FIG. 7A illustrates the triggering system in an inactive state and FIG. 7B illustrates the triggering system in an active state;

DETAILED DESCRIPTION

Figure 1:
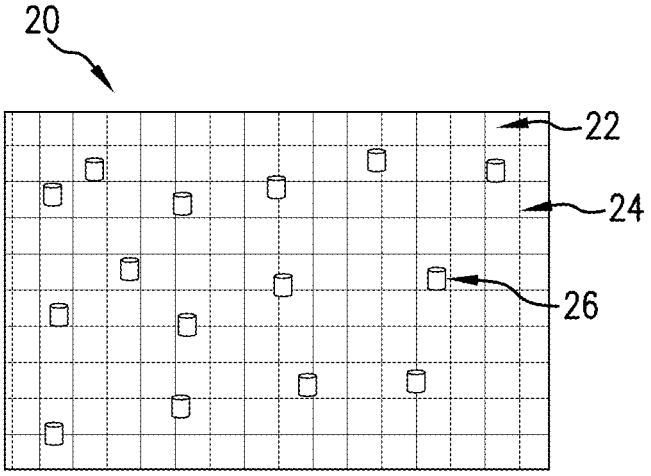
FIG. 1 is a schematic diagram of an exemplary downhole article that includes a matrix material, an energetic material, and a sensor, wherein the energetic material comprises interconnected fibers or wires.

The disclosure provides multifunctional downhole articles that can monitor tool degradation/disintegration status, tool positions and surrounding well conditions such as temperature, pressure, fluid type, concentrations, and the like. Meanwhile, the downhole articles have minimized disintegration rate or no disintegration while the articles are in service but can rapidly degrade in response to a triggering signal or activation command. The degradable downhole articles (alternatively termed disintegrable downhole articles where the degradable downhole articles have complete or partial disintegration) include a degradable-on-demand material including at least a matrix material and an energetic material configured to generate energy upon activation to facilitate the degradation of the degradable article; and may further include a sensor. The degradation, including the partial or complete disintegration, of the articles can be achieved through chemical reactions, thermal cracking, mechanical fracturing, or a combination comprising at least one of the foregoing.

The energetic material can be in the form of continuous fibers, wires, foils, particles, pellets, short fibers, or a combination comprising at least one of the foregoing. In the downhole articles, the energetic material is interconnected in such a way that once a reaction of the energetic material is initiated at one or more starting locations or points, the reaction can self-propagate through the energetic material in the downhole articles. As used herein, interconnected or interconnection is not limited to physical interconnection.

In an embodiment the energetic material comprises continuous fibers, wires, or foils, or a combination comprising at least one of the foregoing and forms a three dimensional network. The matrix material is distributed throughout the three dimensional network. A downhole article having such a structure can be formed by forming a porous preform from the energetic material, and filling or infiltrating the matrix material into the preform under pressure at an elevated temperature. The sensor can be placed at a random or a predetermined location in the downhole article.

In another embodiment, the energetic material is randomly distributed in the matrix material in the form of particles, pellets, short fibers, or a combination comprising at least one of the foregoing. A downhole article having such a structure can be formed by mixing and compressing the energetic material and the matrix material. The sensor can be placed at a random or a predetermined location in the downhole article.

In yet another embodiment, the downhole article comprises an inner portion and an outer portion disposed of the inner portion, where the inner portion comprises a core material that is corrodible in a downhole fluid; and the outer portion comprises the matrix material and the energetic material. The sensor can be disposed in the inner portion of the downhole article, the outer portion of the downhole article, or both. Illustrative core materials include corrodible matrix materials disclosed herein. The inner portion can include a core matrix formed from the core materials. Such a core matrix can have a microstructure as described herein for the corrodible matrix.

When the inner portion is surrounded and encased by the outer portion, the core material in the inner portion of the article and matrix material in the outer portion of the article are selected such that the core material has a higher corrosion rate than the matrix material when tested under the same conditions.

The outer portion of the articles can comprise a network formed by an energetic material in the form of continuous fibers, wires, or foils, or a combination comprising at least one of the foregoing, and a matrix material distributed throughout the network of the energetic material. The outer portion of the downhole articles can also contain an energetic material randomly distributed in a matrix material in the form of particles, pellets, short fibers, or a combination comprising at least one of the foregoing. In an embodiment, the outer portion has a layered structure including matrix layers and energetic material layers. An exemplary layered structure has alternating layers of a matrix material and an energetic material. The arrangement allows for selective removal of a portion of the downhole article upon selective activation of one or more layers of the energetic material.

Once the energetic material in the outer portion of the article is activated, the outer portion disintegrates exposing the inner portion of the article. Since the inner portion of the article has an aggressive corrosion rate in a downhole fluid, the inner portion of the article can rapidly disintegrate once exposed to a downhole fluid.

The matrix material comprises a polymer, a metal, a composite, or a combination comprising at least one of the foregoing, which provides the general material properties such as strength, ductility, hardness, density for tool functions. As used herein, a metal includes metal alloys. The matrix material can be corrodible or non-corrodible in a downhole fluid. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing. The disintegration of the articles can be achieved through chemical reactions, thermal cracking, mechanical fracturing, or a combination comprising at least one of the foregoing. When the matrix material is not corrodible, the downhole article can be disintegrated by physical forces generated by the energetic material upon activation. When the matrix material is corrodible, the downhole article can be disintegrated by chemical means via the corrosion of the matrix material in a downhole fluid. The heat generated by the energetic material can also accelerate the corrosion of the matrix material. Both chemical means and physical means can be used to disintegrate downhole articles that have corrodible matrix materials.

In an embodiment, the corrodible matrix material comprises Zn, Mg, Al, Mn, an alloy thereof, or a combination comprising at least one of the foregoing. The corrodible matrix material can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

It will be understood that corrodible matrix materials will have any corrosion rate necessary to achieve the desired performance of the downhole article once the article completes its function. In a specific embodiment, the corrodible matrix material has a corrosion rate of about 0.1 to about 450 $mg/cm^2$/hour, specifically about 1 to about 450 $mg/cm^2$/hour determined in aqueous 3 wt. % KCl solution at 200° F. (93° C.).

In an embodiment, the matrix formed from the matrix material (also referred to as corrodible matrix) has a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the nanomatrix material.

The matrix can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W. Cu, Fe, Si, Ca, Co, Ta, Re, or No. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the downhole article. The CEM materials including the composites formed therefrom have been described in U.S. Pat. Nos. 8,528,633 and 9,101,978.

The matrix material can be disintegrable polymers and their composites including poly(lactic acid) (PLA), poly (glycolic acid) (PGA), polycaprolactone (PCL), polylactide-co-glycolide, polyurethane such as polyurethane having ester or ether linkages, polyvinyl acetate, polyesters, and the like.

Optionally, the matrix material further comprises additives such as carbides, nitrides, oxides, precipitates, dispersoids, glasses, carbons, or the like in order to control the mechanical strength and density of the downhole article.

The energetic material comprises a thermite, a reactive multi-layer foil, an energetic polymer, or a combination comprising at least one of the foregoing. Use of energetic materials disclosed herein is advantageous as these energetic materials are stable at wellbore temperatures but produce an extremely intense exothermic reaction following activation, which facilitates the rapid disintegration of the downhole articles.

Thermite compositions include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide, and combinations including at least one of the foregoing, for example.

As used herein, energetic polymers are materials possessing reactive groups, which are capable of absorbing and dissipating energy. During the activation of energetic polymers, energy absorbed by the energetic polymers cause the reactive groups on the energetic polymers, such as azido and nitro groups, to decompose releasing gas along with the dissipation of absorbed energy and/or the dissipation of the energy generated by the decomposition of the active groups. The heat and gas released promote the disintegration of the downhole articles.

Energetic polymers include polymers with azide, nitro, nitrate, nitroso, nitramine, oxetane, triazole, and tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly[3-nitratomethyl-3-methyl oxetane] (polyNIMMO), poly(3,3-bis-(azidomethyl)oxetane (polyBAMO) and poly (3-azidomethyl-3-methyl oxetane) (polyAMMO), polyvinylnitrate, polynitrophenylene, nitramine polyethers, or a combination comprising at least one of the foregoing.

The reactive multi-layer foil comprises aluminum layers and nickel layers or the reactive multi-layer foil comprises titanium layers and boron carbide layers. In specific embodiments, the reactive multi-layer foil includes alternating aluminum and nickel layers.

The amount of the energetic material is not particularly limited and is generally in an amount sufficient to generate enough energy to facilitate the rapid disintegration of the downhole articles once the energetic material is activated. In one embodiment, the energetic material is present in an amount of about 0.5 wt. % to about 45 wt. % or about 0.5 wt. % to about 20 wt. % based on the total weight of the downhole articles.

The downhole articles also include a sensor, which is operative to receive and process a signal to activate an energetic material, to determine a parameter change to trigger the activation of an energetic material, or to monitor a parameter of the downhole article, a downhole assembly comprising the downhole article, a well condition, or a combination comprising at least one of the foregoing. The parameter includes the disintegration status of the downhole article, the position of the downhole article, the position of the downhole assembly, pressure or temperature of the downhole environment, downhole fluid type, flow rate of produced water, or a combination comprising at least one of the foregoing. The sensor comprises a sensor material, a sensor element, or a combination comprising at least one of the foregoing. A downhole article can include more than one sensor, where each sensor can have the same or different functions.

To receive and process a signal to activate an energetic material, the sensor can include a receiver to receive a disintegration signal, and a triggering component that is effective to generate an electric current. Illustrative triggering component includes batteries or other electronic components. Once a disintegration signal is received, the triggering component generates an electric current and triggers the activation of the energetic material. The disintegration signal can be obtained from the surface of a wellbore or from a signal source in the well, for example, from a signal source in the well close to the downhole article.

In some embodiments, no external signal source is needed. The sensor can detect a parameter of interest such as a pressure, stress, or mechanical force applied to the disintegrable. Once the detected value exceeds a predetermined threshold value, the sensor generates an electrical signal which triggers the activation of the energetic material. Illustratively, a piezoelectric material can be used as the sensor material. The piezoelectric material detects a pressure such as hydraulic pressure, stress, or mechanical force applied to the downhole article. In the event that the detected pressure, stress, or mechanical force is greater than a predetermined value, the piezoelectric material generates an electrical charge to activate the energetic material.

The disintegrable sensor can also be configured to determine the disintegration status of the downhole article. For example, sensors with different tracer materials can be placed at different locations of the downhole article. The disintegration of the downhole article releases the tracer materials. Depending on the type of tracer materials detected, real time disintegration status can be determined. Alternatively or in addition, in the event that the matrix material releases a detectable chemical upon corrosion, the detectable chemical can also be used to provide disintegration information of the downhole article.

In some embodiments, the sensor includes chemical sensors configured for elemental analysis of conditions (e.g., fluids) within the wellbore. For example, the sensor can include carbon nanotubes (CNT), complementary metal oxide semiconductor (CMOS) sensors configured to detect the presence of various trace elements based on the principle of a selectively gated field effect transistors (FET) or ion sensitive field effect transistors (ISFET) for pH, $H_2S$ and other ions, sensors configured for hydrocarbon analysis, CNT, DLC based sensors that operate with chemical electropotential, and sensors configured for carbon/oxygen analysis. Some embodiments of the sensor may include a small source of a radioactive material and at least one of a gamma ray sensor or a neutron sensor.

The sensor can include other sensors such as pressure sensors, temperature sensors, stress sensors and/or strain sensors. For example, pressure sensors may include quartz crystals. Piezoelectric materials may be used for pressure sensors. Temperature sensors may include electrodes configured to perform resistivity and capacitive measurements that may be converted to other useful data. Temperature sensors can also comprise a thermistor sensor including a thermistor material that changes resistivity in response to a change in temperature.

In some embodiments, the sensor includes a tracer material such as an inorganic cation; an inorganic anion; an isotope; an activatable element; or an organic compound. Exemplary tracers include those described in US 20160209391. The tracer material can be released from the downhole articles while the articles disintegrate. The concentration of the release tracer material can be measured thus providing information such as concentration of water or flow rate of produced water.

The sensor may couple with a data processing unit. Such data processing unit includes electronics for obtaining and processing data of interest. The data processing unit can be located downhole or on the surface.

The microstructures of the exemplary downhole articles according to various embodiments of the disclosure are illustrated in FIGS. 1-4. Referring to FIG. 1, the downhole article 20 includes matrix 22, energetic material 24, and sensors 26. The energetic material forms an interconnected network. The sensors are randomly or purposely positioned in the downhole article.

Figure 2:
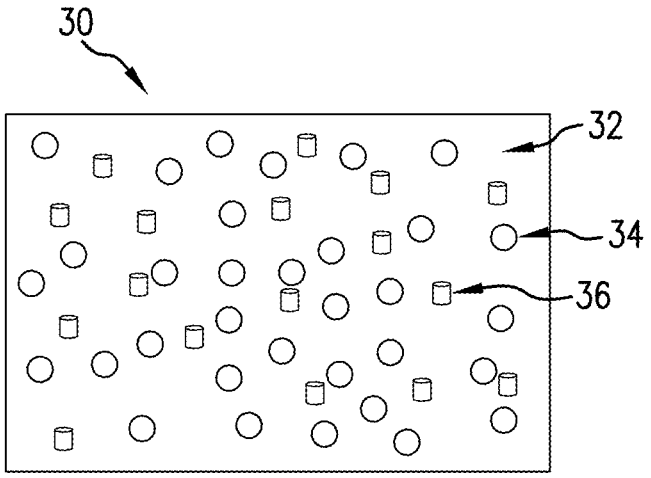
FIG. 2 is a schematic diagram of an exemplary downhole article that includes a matrix material, an energetic material, and a sensor, wherein the energetic material is randomly distributed in the matrix material.

The downhole article 30 illustrated in FIG. 2 includes matrix 32, energetic material 34, and sensors 36, where the energetic material 34 is randomly dispersed within matrix 32 as particles, pellets, short fibers, or a combination comprising at least one of the foregoing.

Figure 3:
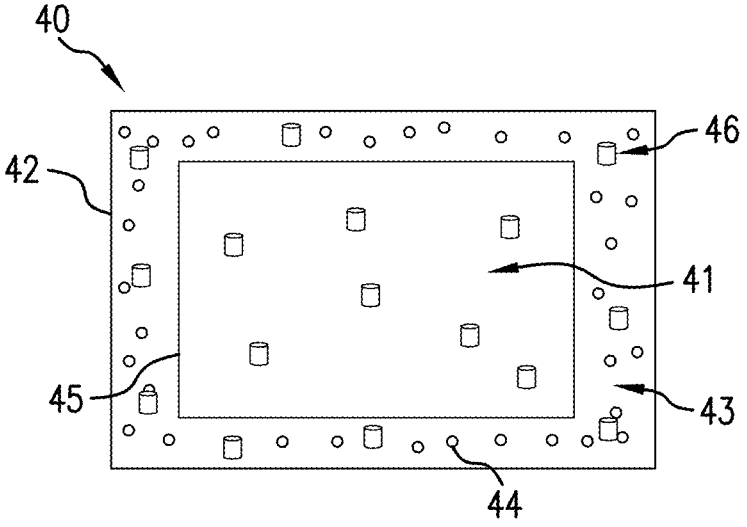
FIG. 3 is a schematic diagram of an exemplary downhole article that includes an inner portion and an outer portion disposed of the inner portion, the inner portion comprising a disintegrable material, and the outer portion comprising a matrix material and an energetic material.

The downhole article 40 illustrated in FIG. 3 includes an inner portion 45 and an outer portion 42, wherein the inner portion 45 contains a core material 41 and the outer portion 42 contains an energetic material 44 and matrix 43. Sensors 46 can be positioned in the inner portion 45, in the outer portion 42, or both. Although in FIG. 3, it is shown that the energetic material 44 is randomly distributed in the matrix 43 in the outer portion 42 of the downhole article 40, it is appreciated that the outer portion 42 can also have a structure as shown in FIG. 1 for article 20.

Figure 4:
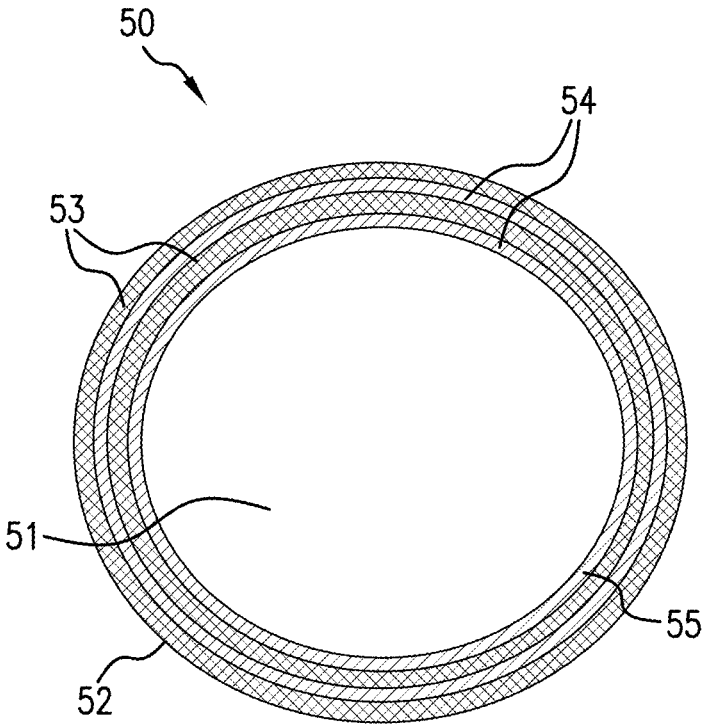
FIG. 4 is a schematic diagram of another exemplary downhole article that includes an inner portion and an outer portion disposed of the inner portion, wherein the outer portion includes a layered structure.

The downhole article 50 illustrated in FIG. 4 includes an inner portion 55 and an outer portion 52, wherein the inner portion 55 contains a core material 51 and the outer portion 52 has a layered structure that contains matrix layers 53 and energetic material layers 54. Sensors (not shown) can be disposed in the inner portion, the outer portion, or both.

Downhole articles in the downhole assembly are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the downhole article is a ball, a fracture plug, a whipstock, a cylinder, or a liner plug. A downhole assembly comprising the downhole article is also provided.

The downhole articles disclosed herein can be controllably removed such that significant disintegration only occurs after these articles have completed their functions. A method of controllably removing a downhole article comprises disposing a downhole article comprising a matrix material, an energetic material, and a sensor in a downhole environment; performing a downhole operation; activating the energetic material; and disintegrating the downhole article.

The method further comprises determining a parameter of the downhole article, a downhole assembly comprising the downhole article, the downhole environment, or a combination comprising at least one of the foregoing. The parameter comprises disintegration status of the downhole article, the position of the downhole article, position of the downhole assembly, pressure or temperature of the downhole environment, flow rate of produced water, or a combination comprising at least one of the foregoing.

The methods allow for a full control of the disintegration profile. The downhole articles can retain their physical properties until a signal or activation command is produced. Because the start of the disintegration process can be controlled, the downhole articles can be designed with an aggressive corrosion rate in order to accelerate the disintegration process once the articles are no longer needed.

The downhole article or a downhole assembly comprising the same can perform various downhole operations while the disintegration of the article is minimized. The downhole operation is not particularly limited and can be any operation that is performed during drilling, stimulation, completion, production, or remediation.

Once the downhole article is no longer needed, the disintegration of the article is activated. The method can further comprise receiving an instruction or signal from above the ground or generating an instruction or signal downhole to activate the energetic material. Activating the energetic material may in some embodiments include providing a command signal to the downhole article, the command signal comprising electric current, electromagnetic radiation such as microwaves, laser beam, mud pulse, hydraulic pressure, mechanical fore, or a combination comprising at least one of the foregoing. The command signal can be provided above the surface or generated downhole. In an embodiment, activating the energetic material comprises detecting a pressure, stress, or mechanical force applied to the downhole article to generate a detected value; comparing the detected value with a threshold value; and generating an electrical change to activate the energetic material when the detected value exceeds the threshold value. In another embodiment, activating the energetic material includes receiving a command signal by the sensor, and generating an electric current by the sensor to activate the energetic material. Activating the energetic material can further comprise initiating a reaction of the energetic material to generate heat.

Figure 5:
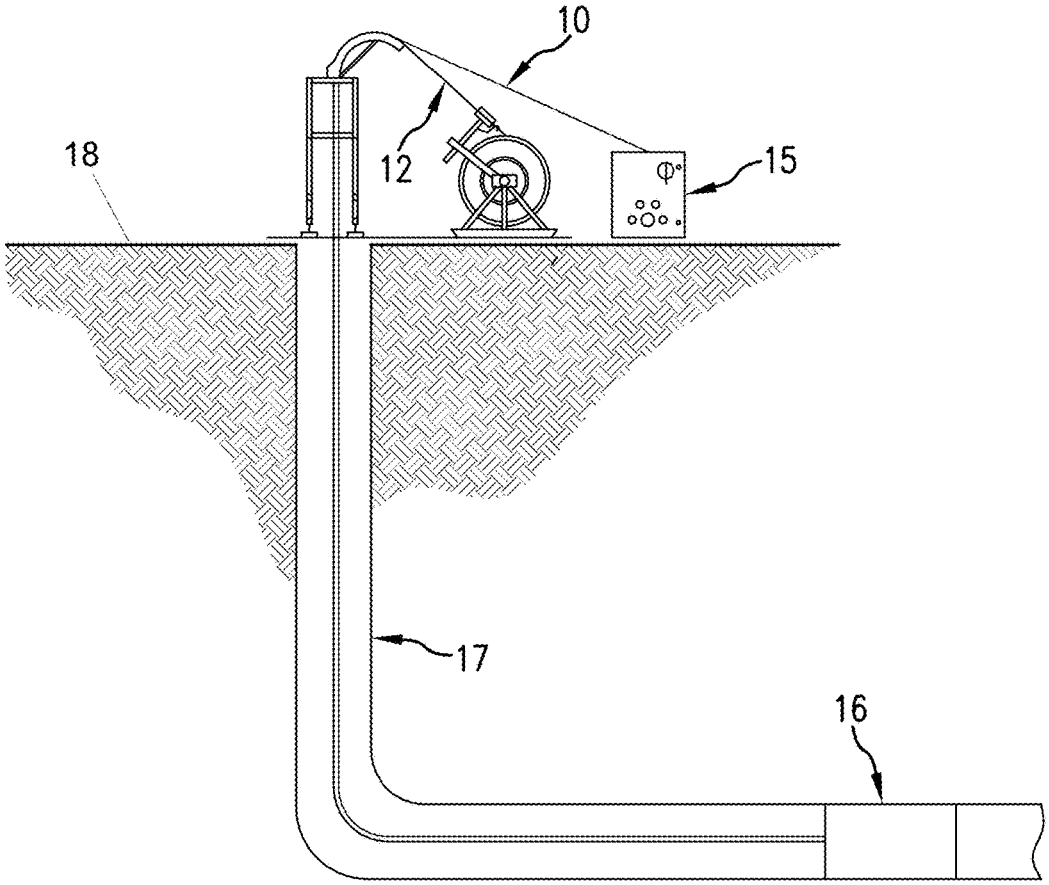
FIG. 5 is a schematic diagram illustrating a downhole assembly disposed in a downhole environment according to an embodiment of the disclosure.

Referring to FIG. 5, a downhole assembly 16 is disposed in borehole 17 via a coil tubing or wireline 12. A communication line 10 couples the downhole assembly to a processor 15. The communication line 10 can provide a command signal such as a selected form of energy from processor 15 to the downhole assembly 16 to activate the energetic material in the downhole assembly 16. The communication line 10 can also process the data generated by the sensor in the downhole article to monitor the disintegration status of the downhole assembly 16, position of the downhole assembly and the well conditions. The communication line 10 can be optical fibers, electric cables or the like, and it can be placed inside of the coil tubing or wireline 12.

Figure 6A:
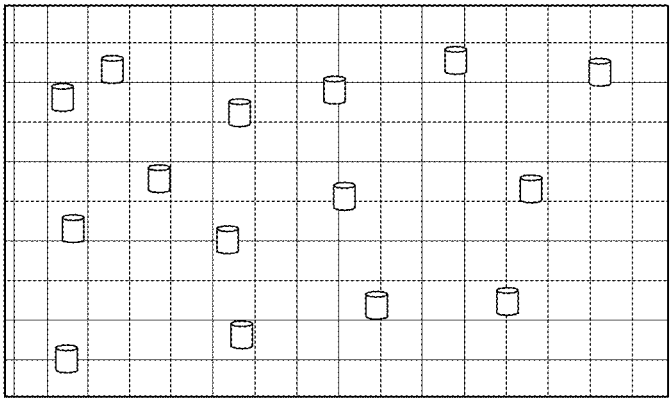
FIGS. 6A-6F illustrate a process of disintegrating a downhole article according to an embodiment of the disclosure, where
Figure 6B:
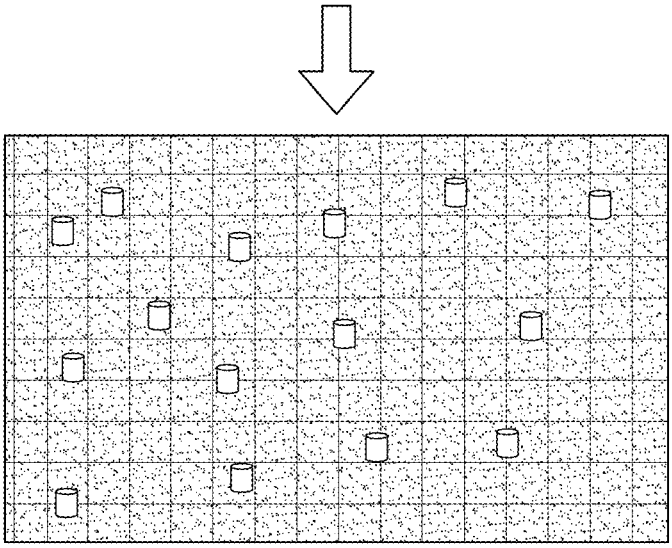
Figure 6C:
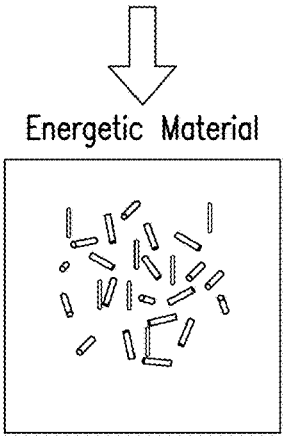
Figure 6D:
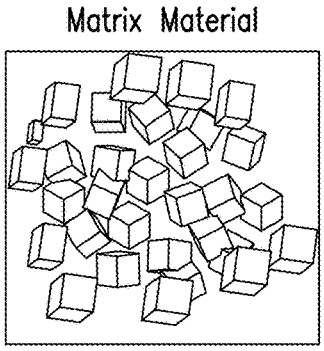
Figure 6E:
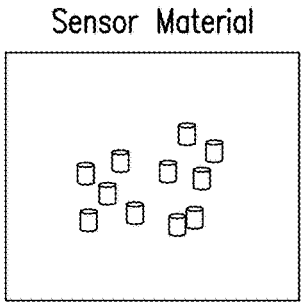
Figure 6F:
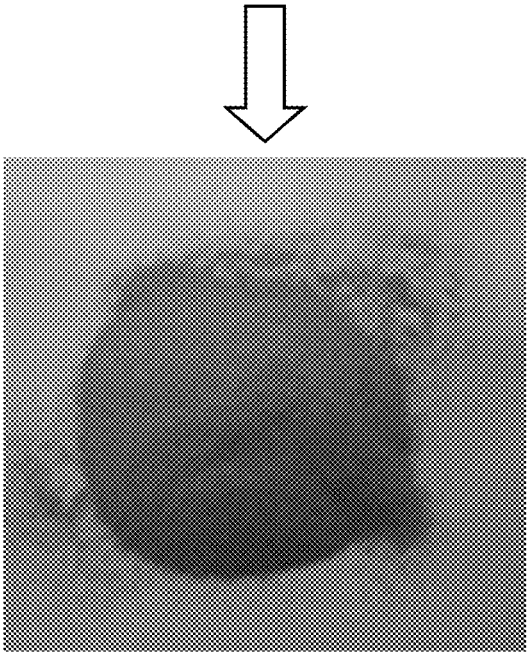

Referring to FIGS. 6A-6E, before activation, a downhole article as shown in FIG. 6A contains an energetic material network, a matrix, and sensors. After activation, heat is generated, and the disintegration article as shown in FIG. 6B breaks into small pieces, such as an energetic material, a matrix material, and a sensor material as shown in FIGS. 6C, 6D, and 6E respectively. In an embodiment, the small pieces can further corrode in a downhole fluid forming powder particles as shown in FIG. 6F. The powder particles can flow back to the surface thus conveniently removed from the wellbore.

Figure 7A:
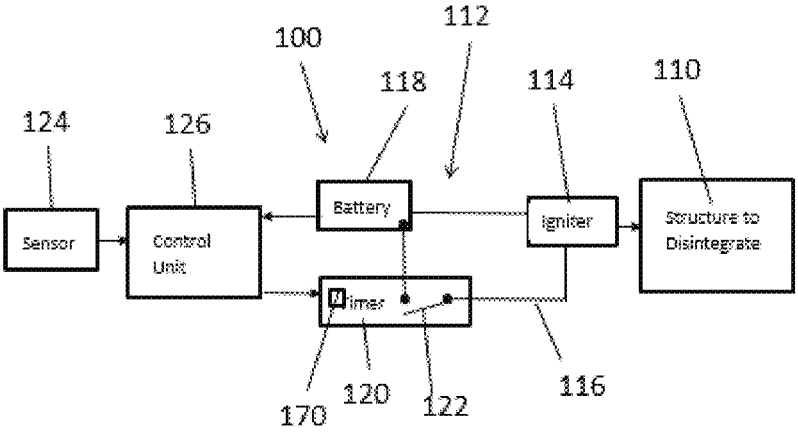
FIGS. 7A and 7B schematically illustrate an embodiment of a downhole assembly having a triggering system, where
Figure 7B:
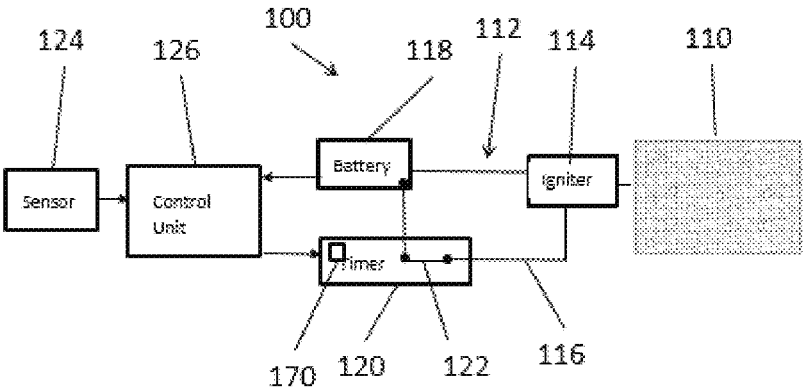

FIGS. 7A-7B illustrate an embodiment of a downhole assembly 100 that includes a degradable downhole tool 110, including both partially and completely disintegrable downhole tools, as well as a triggering system 112 for the initiation of the ignition of the degradation of the tool 110. The downhole tool 110 incorporates any of the above-described arrangements of a downhole article in at least a portion of the downhole tool 110. That is, the downhole tool is at least partially formed from a degradable-on-demand material including the above-described energetic material. The energetic material can be in the form of continuous fibers, wires, foils, particles, pellets, short fibers, or a combination comprising at least one of the foregoing. In the degradable-on-demand portion of the downhole tool 110, the energetic material is interconnected in such a way that once a reaction of the energetic material is initiated at one or more starting locations or points, the reaction can self-propagate through the energetic material in the degradable-on-demand components. As used herein, interconnected or interconnection is not limited to physical interconnection. Also, the degradable-on-demand material further includes the above-noted matrix material, and may further include the sensor. In some embodiments, the downhole tool 110 may be entirely composed of a downhole article, whereas in other embodiments only certain parts of the downhole tool 110 are composed of a downhole article.

The degradable-on-demand material does not begin degradation until a time of a detected target event or parameter, or pre-selected time period after the detected target event or parameter, that is chosen by an operator (as opposed to a material that begins degradation due to conditions within the borehole 17), thus the degradation is controllable, and may further be exceedingly more time efficient than waiting for the material to degrade from borehole conditions. In some embodiments the time period after the detected target event or parameter is chosen by an operator by setting a timer 120 and providing the appropriate programming in a control unit 126 (which can be done by the manufacturer or operator), as will be further described below. In addition to the degradable-on-demand material, the downhole tool 110 may include any or all of the features shown in FIGS. 7A and 7B directly within the footprint of the downhole tool 110. The downhole assembly 100, including both the downhole tool 110 having the downhole article and the triggering system 112, may be packaged in a single, self-contained unit that can be run downhole so that the article 110 can serve a downhole function prior to degradation. That is, the triggering system 112 may be directly attached to, embedded within, or otherwise incorporated into the downhole tool 110. The schematic view of the triggering system 112 is exaggerated for clarity, and may be of various sizes and locations with respect to the downhole tool 110. For example, if the downhole tool 110 is, for example, a sleeve or frac plug, which is designed to allow flow through the borehole 17 in one or both downhole and uphole directions, then the triggering system 112 would be arranged so as to not block a flowbore of the tool 110.

The triggering system 112 includes an igniter 114 arranged to directly ignite the tool 110, directly ignite another material that then directly ignites the downhole tool, or directly ignite the downhole article within the downhole tool 110 if the downhole tool 110 is not made entirely of the degradable-on-demand material. In particular, the igniter 114 may be arranged to directly engage with and ignite at least one starting point of the energetic material. In the illustrated embodiment, the triggering system 112 further includes an electrical circuit 116. In FIG. 7A, the circuit 116 is open so that the igniter 114 is not activated, not provided with electric current, and thus does not ignite the article 110. In FIG. 7B, the circuit 116 is closed so that battery 118 starts to provide electric current to activate and set off the igniter 114, which initiates the degradation of the degradable-on-demand material within the downhole tool 110 that the triggering system 112 is embedded in or otherwise attached to. In some embodiments, closure of the circuit 116 is enacted by the timer 120. While the battery 118 could be separately connected to the timer 120 for operation of the timer 120, the timer 120 preferably includes its own separate battery 170 so that the battery 118 is dedicated to the igniter 114 to ensure sufficient energy release at the time of ignition. The timer 120 can be programmed for a particular time period at surface 18 (see FIG. 5), or by a manufacturer, for a predetermined time period after a designated event, sensed by sensor 124, has occurred. The sensor 124 may be the same sensor (26, 36, 46) that is utilized within the degradable-on-demand material. That is, the sensor 124 may include one or more sensors dispersed (placed at random or predetermined locations) within the degradable-on-demand material. Alternatively, the sensor 124 may be housed with other elements of the triggering system 112, which is then placed in contact with the energetic material of the degradable-on-demand material. Also, the downhole assembly 100 may include both the sensor 124 as part of the triggering system 112, and one or more additional sensors (26, 36, 46) that are formed within the degradable-on-demand material. In one embodiment, the sensor 124 may be configured to detect a first event or first parameter (a target event or parameter) within the borehole 17 that would be indicative of a time to start the timer 120, and the degradable-on-demand material may include one or more second sensors (26, 36, 46) dispersed within the degradable material configured to detect a second event or second parameter of the downhole tool 110, the downhole assembly 100, a well condition, or a combination comprising at least one of the foregoing, where the second event or second parameter is different than the first event or first parameter. Signals related to the second event or second parameter may be stored, read, or sent to surface 18 or another remote location for operator information as previously described.

The time period may also be altered by the control unit 126 depending on the sensed data sensed by sensor 124. For the purposes of these embodiments, the sensor 124 may include one or more different types of sensors for sensing one or more different parameters or events that together would be indicative of an occurrence of a target parameter or event. The sensor 124 may thus include one or more sensors configured to sense, for example, pressure, temperature, velocity, density, chemicals, electrochemicals, and/or electromagnetic tags. Depending on the parameter or event, the predetermined time period could be as low as zero seconds, such that the circuit 116 would close substantially immediately after detection of the target parameter or event, or could be any time period greater than zero seconds including, but not limited, to several hours. The predetermined time period would depend on the downhole tool 110 and the target parameter or event. Having the timer 120 within the self-contained unit of the downhole tool 110 and triggering system 112 enables the unit to be independent of physical connections to surface 18 with respect to control of the triggering system 112. While the timer 120 can be set to close the switch 122 after any pre-selected time period, in one embodiment, the timer 120 remains inactive and does not start the time period until dictated by the control unit 126, as will be further described below. Once the timer 120 is initiated, such as by a start signal from the control unit 126 which will begin the timer 120, the time period commences. In one embodiment, the time period may be set such that the switch 122 closes after the expected completion of a procedure in which the downhole tool 110 is utilized. Once the downhole tool 110 is no longer required, the circuit 116 can be closed in order to permit the battery 118 to provide electric current to set off the igniter 114. As demonstrated by FIG. 7B, once the circuit 116 is in the closed condition, and igniter 114 is activated, heat is generated, and the downhole article within the downhole tool 110 breaks into small pieces, such as an energetic material, a matrix material, and a sensor material. The degradation of the downhole tool 110 is controlled and does not involve a rupture or detonation that may uncontrollably direct pieces of the degraded downhole tool 110 forcefully into other remaining downhole structures.

In an embodiment where it is known that degradation of the downhole tool 110 is desired immediately after the sensed signal reaches a target value indicating an occurrence of the target parameter or event, then the time period in the timer 120 to close switch 122 can be set to zero. In some embodiments where immediate degradation is desired, the timer 120 is not included in the triggering system 112, and upon detection of the threshold or target value of the sensed signal by the control unit 126 or other sensed signal that indicates the occurrence of the target event or parameter, the control unit 126 may send the start signal to the electrical circuit 116 to start the initiation of the igniter 114, such as by closing the switch 122 to place the electrical circuit 116 in the closed condition.

Figure 8:
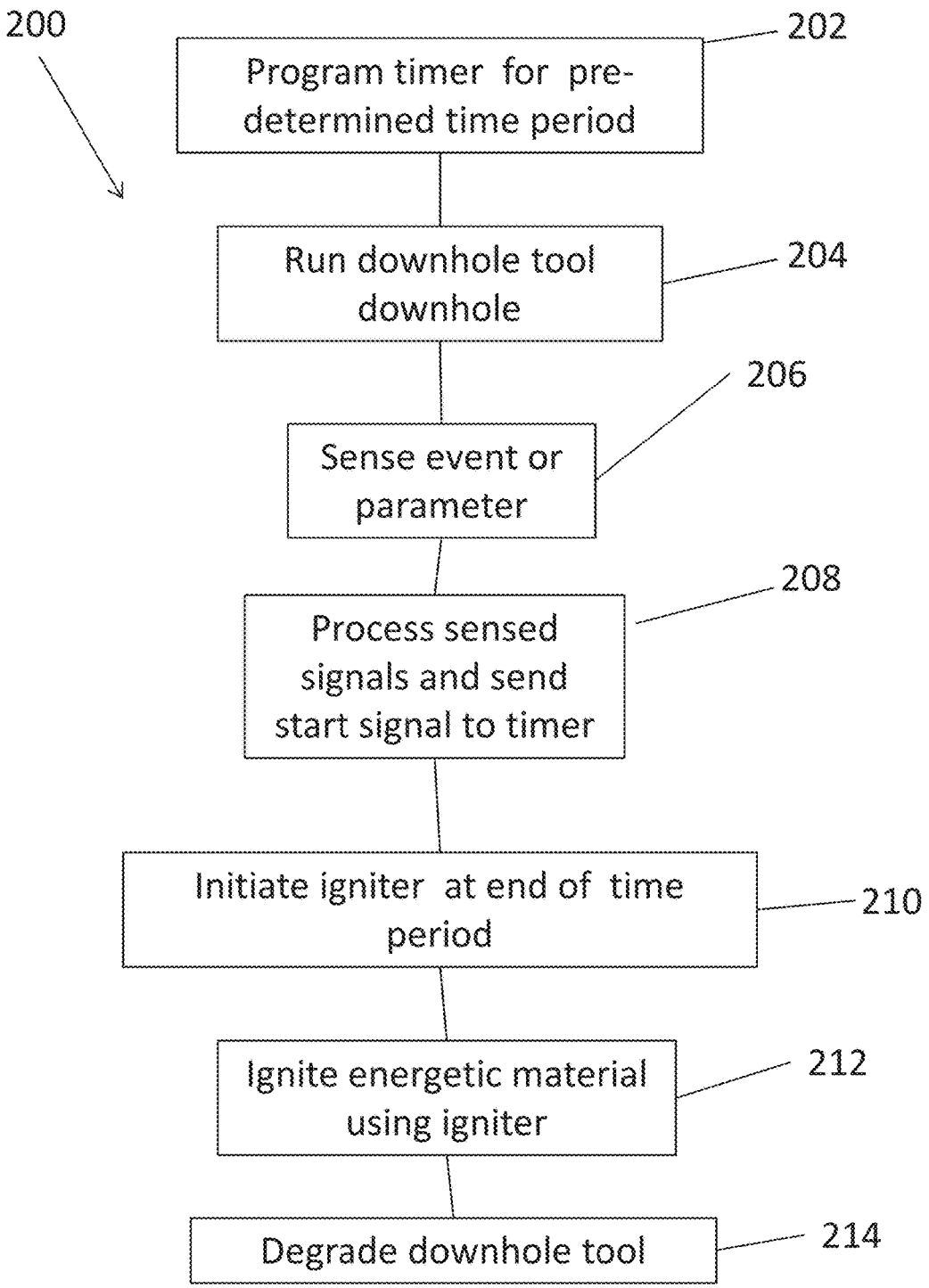
FIG. 8 is a flowchart of an embodiment of a method of degrading a downhole tool.

FIG. 8 is a flowchart of an embodiment of a method 200 of employing the triggering system 112 to degrade the downhole tool 110 of the downhole assembly 100. As indicated by box 202, the timer 120 is set by an operator or by a manufacturer, however the timer 120 remains inactive (the timer is not yet started) at this stage. As indicated by box 204, the downhole tool 110 is run downhole within borehole 17. The downhole tool 110 may be attached to any other equipment, tubing string, and other downhole tools that form the entirety of the downhole assembly 100. As indicated by box 206, a target event or parameter occurs within the borehole 17 that is sensed by sensor 124. The target event or parameter could include, but is not limited to, a shock wave from perforation gun firing; a mud pulse; vibration caused by fluids being pumped through the downhole assembly 100; a pressure differential across the downhole tool 110 such as hydraulic fracturing pressure acting across a frac plug; electric-magnetic wave sent from a bottom hole assembly to treat a next zone, sent from surface or from on-going operations in a neighboring well; a chemical or electrochemical signal, and/or an electromagnetic tag. The sensed target event or parameter may also include a combination of events and/or parameters, such that the control unit 126 would not send a start signal to the timer 120, or alternatively would not send a start signal to the electrical circuit 116 when the timer 120 is not included in the triggering system 112, until all of the threshold events/and or parameters have been detected. As indicated by box 208, the control unit 126 receives the sensed signal(s) from the sensor 124 and processes the signals to verify validity for starting the timer 120. That is, the signals are processed to determine whether or not they meet the requirements for starting the timer 120. The requirements for starting the timer 120 can be programmed into the control unit 126, and the control unit 126 will process the sensed signals and compare them with threshold (target) values to determine whether or not to send the start signal to the timer 120. In some embodiments, the control unit 126, or alternatively another controller within the triggering system 112, may further change the predetermined time period in response to the sensed signals. Once the start signal is sent to timer 120, the timer 120 will run for the predetermined time period. If the time period is zero, the circuit 116 will close substantially immediately, and if the time period is greater than zero then the circuit 116 will remain open until the end of the time period. In either case, when the circuit 116 is closed, the igniter 114 will be initiated, as indicated by box 210. As indicated by box 212, once the igniter 114 is active, the energetic material is ignited and activated, which, as indicated by box 214, leads to degradation of the downhole tool 110.

Figure 9:
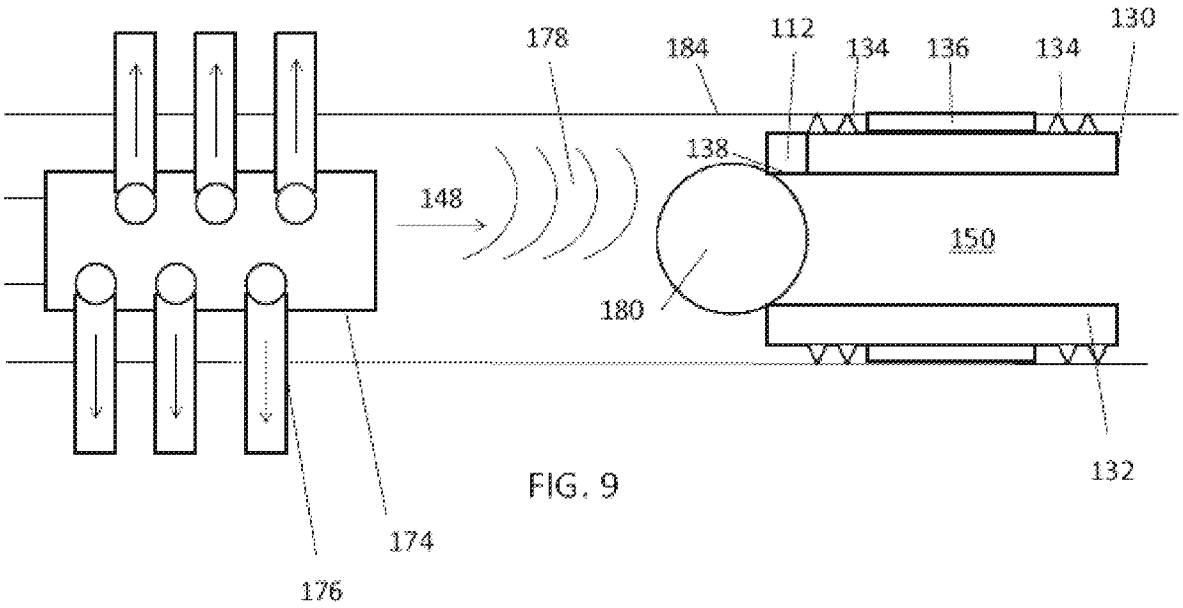
FIG. 9 schematically illustrates an embodiment of a method of degrading a downhole tool including sensing a shock wave.

FIG. 9 illustrates one embodiment of downhole tool 110 usable in the method of degrading a downhole tool. In this embodiment, the downhole tool 110 is a frac plug 130. The frac plug 130 includes a body 132, slips 134, and a resilient member 136. The triggering system 112 is disposed in contact with the degradable-on-demand material of the frac plug 130, such as by being attached or embedded therein. At surface 18, the slips 134 and resilient member 136 have a first outer diameter which enables the frac plug 130 to be passed through the borehole 17. When the frac plug 130 reaches a desired location within the borehole 17, the frac plug 130 is set, such as by using a setting tool (not shown), to move the slips 134 radially outwardly to engage with an inner surface of a casing 184 lining the borehole 17 to prevent longitudinal movement of the frac plug 130 with respect to the borehole 17. At the same time, the resilient member 136 sealingly engages with the inner surface of the casing 184. The timer 120 (FIGS. 7A-7B) in the triggering system 112 is inactive when the frac plug 130 is run downhole. To prevent flow through flowbore 150 in a downhole direction 148, so as to enable the application of a pressure increase uphole of the frac plug 130, a frac ball 180 is landed on the frac plug 130. In particular, the frac ball 180 lands on seat 138. To perforate the casing 184 to access the formation, a perforating gun 174 is fired uphole of the frac plug 130 to create casing perforations 176. The pressure pulse 178 in the fluid generated by firing of the perforating guns 174 is detected by the sensor 124, which can include the sensor in the degradable-on-demand material, within the triggering system 112. The control unit 126 processes the sensed signal from the sensor 124, and once confirmed to be within the threshold range of a pressure pulse 178 from the perforating guns 174, the sensor 124 sends the start signal to the timer 120 to start the timer 120. Once the time period set in the timer 120 has elapsed, the igniter 114 will ignite the energetic material in the frac plug 130 to intentionally begin its degradation. Alternatively, the timer 120 may be removed such that the control unit 126 will close the switch 122 to close the electrical circuit 116 directly. In such an embodiment, the start signal sent by the control unit 126 will serve to close the electrical circuit 116, thus activating the igniter 114 instead of starting the timer 120.

In one embodiment, only select portions of the frac plug 130 are formed of the above-described degradable-on-demand material, such as, but not limited to the body 132. In another embodiment, other portions of the frac plug 130 are not formed of the degradable-on-demand material, however, such other portions may be formed of a different degradable material, such as but not limited to the matrix material not including the energetic material, that can be effectively and easily removed once the downhole article made of the degradable-on-demand material of the frac plug 130 has been degraded, including partial or full disintegration, during the degradation of the downhole article within the frac plug 130. When only one part of the frac plug 130 is made of degradable-on-demand material, such as, but not limited to the body 132 or cone (such as a frustoconical element), the degradation of that part will eliminate the support to the other components such as, but not limited to, the slip 134. In this way, the frac plug 130 can collapse off from the casing 184 to remove obstacle to flow path on-demand; in addition, degradable-on-demand material generates heat which can speed up the degradation of the rest of the frac plug 130.

Figure 10:
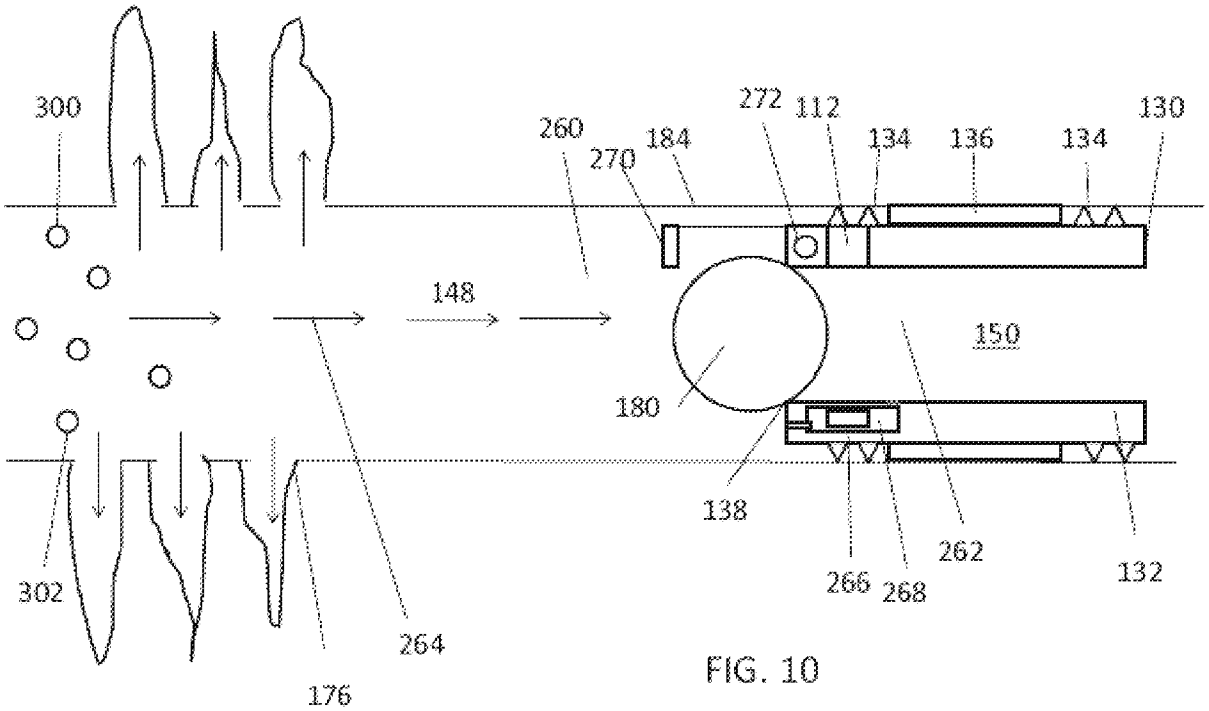
FIG. 10 schematically illustrates an embodiment of a method of degrading a downhole tool including sensing a pressure differential, vibrations, chemical or electrochemical signal, and/or electromagnetic tag.

FIG. 10 illustrates alternative or additional embodiments in which the method 200 of degrading a downhole tool 110 can be utilized. In one embodiment, the frac plug 130 is set within the casing 184 (or alternatively the borehole 17 if not lined with casing) and a pressure differential is detected by the sensor 124 within the triggering system 112 across the frac ball 180. In particular, a pressure in an uphole area 260 uphole of the frac plug 130 is compared with respect to a pressure in a downhole area 262 (separated from uphole area 260 when frac ball 180 lands on the frac plug 130) of the frac plug 130. In one embodiment, the sensor 124 may include a piston 266 arranged and sealed within a piston chamber 268 in the frac plug 130 where an uphole end of the piston chamber 268 is in fluid communication with the uphole area 260, and a downhole end of the piston chamber 268 is in fluid communication with the downhole area 262, such as by using access ports as shown. For clarity, the piston 266 is schematically depicted on a diametrically opposite side of the frac plug 130 from the triggering system 112, however the piston 266 may be positioned adjacent to or otherwise in communication with the triggering system 112. Before the frac ball 180 lands, the piston 266 may be balanced within the chamber 268. However, after the frac ball 180 lands, a particular amount of increased pressure in the uphole area 260 will shift the piston 266 in the downhole direction 148 within the piston chamber 268. When fracturing fluids 264 are utilized in a fracturing operation, the pressure in the uphole area 260 will be significantly greater than a pressure in the downhole area 262. At a particular sensed pressure differential, such as at a pressure differential which is indicative of a beginning of a fracturing operation, the piston 266 will shift within the chamber 268 in the downhole direction 148 and the position shift will be detected using the sensor 124 and the control unit 126 will send the start signal to the timer 120. The time period set in the timer 120 may be approximately the expected duration of a fracturing operation. Alternatively, the timer 120 may be removed such that the control unit 126 will close the switch 122 to close the electrical circuit 116 directly. In such an embodiment, the start signal sent by the control unit 126 will serve to close the circuit 116, thus activating the igniter 114 instead of starting the timer 120.

In another embodiment, also schematically depicted in FIG. 10, vibration is used to trigger the degradation of the downhole tool 110, such as, but not limited to, the frac plug 130. The sensor 124 in the triggering system 112 is employed to detect vibration of a vibratory element 270, 272. The vibratory element 270, 272 can include any element that will vibrate at a known frequency with a given flow rate in the flowbore 150. In one embodiment, the vibratory element 270 includes a reed. The reed 270 is positioned in the uphole area 260 and may extend substantially perpendicular to the direction of flow so that the reed 270 will vibrate in response to fluid flow. In another embodiment, the vibratory element 272 includes a ball, which may be caged and in fluid communication with the uphole area 260. Flow, such as from frac fluids 264 which may include proppant, will interact with the vibratory element 270, 272, causing it to vibrate. The frequency of the vibrations of the vibratory element 270, 272 will be compared in the control unit 126 to the threshold frequency at the known flow rate of the frac fluids 264. Once the control unit 126 determines that the fracturing operation has commenced, the start signal is sent to the timer 120 to begin the time period. The time period set in the timer 120 may be approximately the expected duration of a fracturing operation. Alternatively, the timer 120 may be removed such that the control unit 126 will close the switch 122 to close the electrical circuit 116 directly. In such an embodiment, the start signal sent by the control unit 126 will serve to close the circuit 116, thus activating the igniter 114 instead of starting the timer 120.

Figure 11:
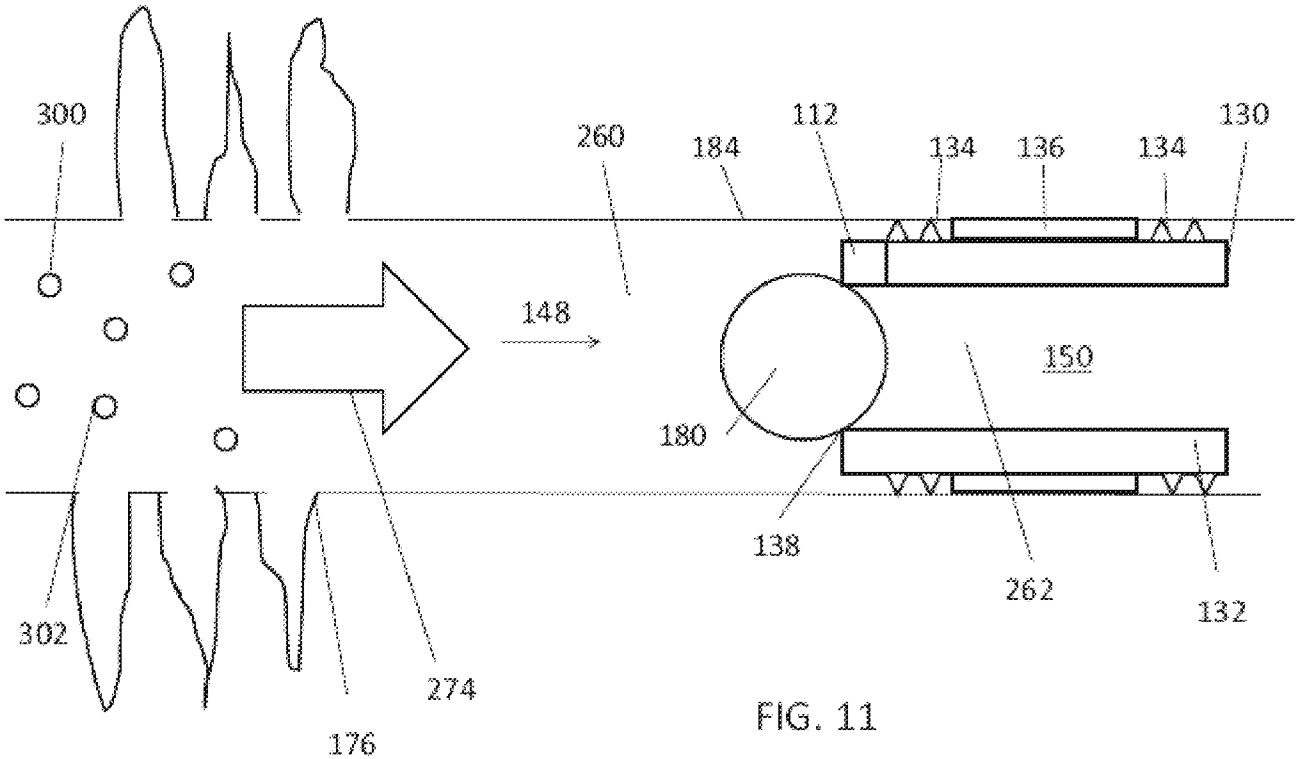
FIG. 11 schematically illustrates an embodiment of a method of degrading a downhole tool including sensing a mud pulse, chemical or electrochemical signal, and/or electromagnetic tag.

FIG. 11 schematically illustrates another embodiment of the method 200. In this embodiment, the frac plug 130 has already been set, the ball 180 dropped, and the frac operation has already been completed. At this point, the frac plug 130 has served its purpose and can be removed. A mud pulse 274, which can include any pressure wave generated in the uphole area 260 of the flowbore 150, is sent to the frac plug 130. The sensor 124, which can include the sensor in the degradable-on-demand material of the frac plug 130, will detect the mud pulse and send a sensed signal to the control unit 126. The control unit 126 will compare the sensed signal to a threshold value. In one embodiment, once the sensed signal is determined to reach the threshold value, the control unit 126 will send a start signal to the timer 120, and the timer 120 will begin the time period before closing the circuit 116. Since the frac plug 130 is no longer required, and can be removed immediately, the time period may be set to zero such that the switch 122 closes the electrical circuit 116 to set off the igniter 114 substantially immediately. Alternatively, the timer 120 may be removed, or need not be included, such that the control unit 126 will close the electrical circuit 116 directly, such as by closing the switch 122, thus activating the igniter 114.

Figure 12:
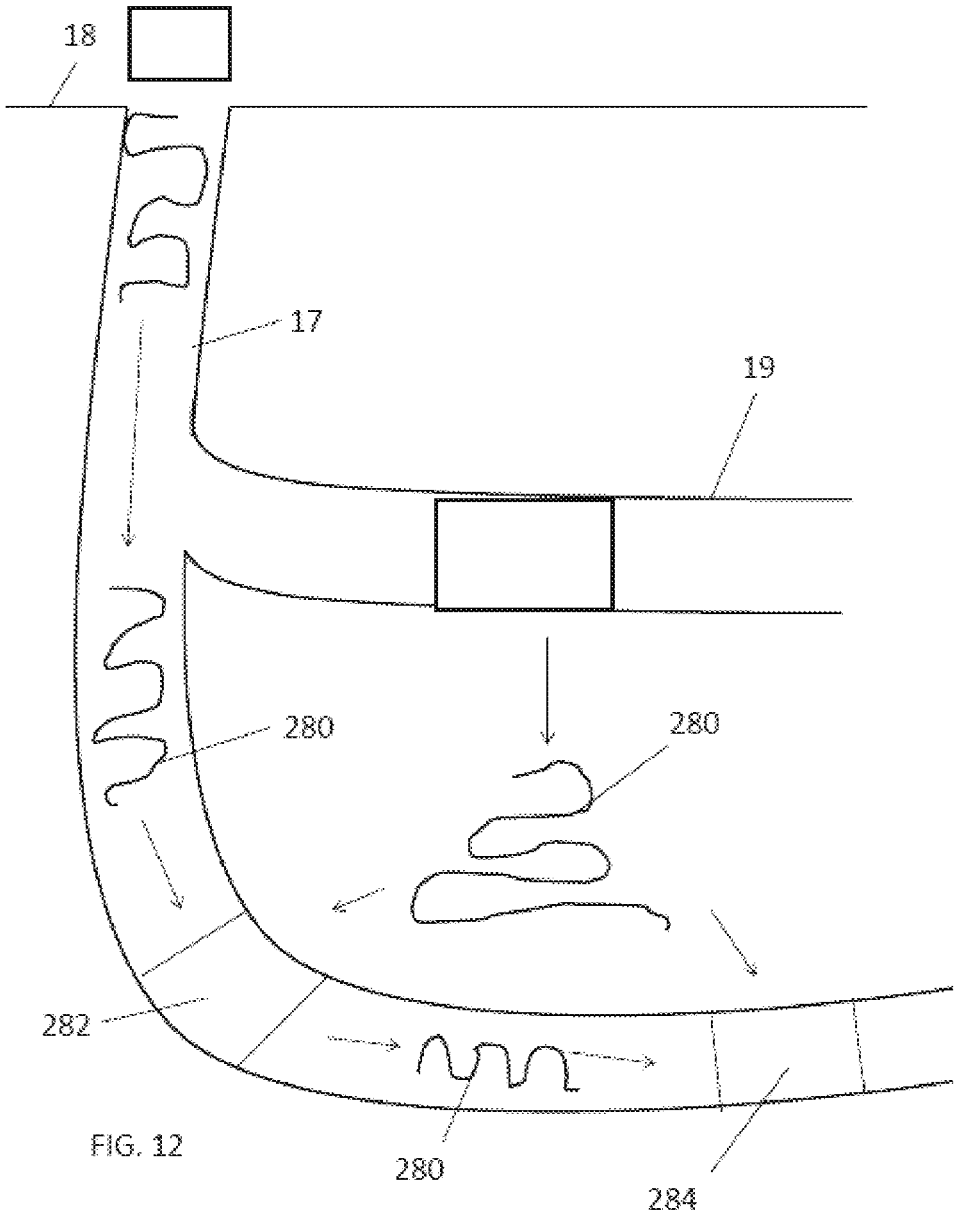
FIG. 12 schematically illustrates an embodiment of a method of degrading a downhole tool including detecting an electromagnetic wave; and, FIGS. 13A and 13B schematically illustrate an embodiment of a downhole assembly having a flapper valve having a flapper formed at least substantially of degradable-on-demand material, where

Referring now to FIG. 12, other methods of degrading a downhole tool are schematically shown. In each embodiment shown in FIG. 12, the sensor 124 in the triggering system 112 is configured to sense an electromagnetic wave 280. In particular, the sensor 124 includes a detector or receiver, such as one having an antenna, which will detect the presence of a particular frequency or range of frequencies of electromagnetic wave 280. In one embodiment, the electromagnetic wave 280 generated from surface 18 is detected by the downhole tool 282 (which includes any of the features of the downhole tool 110), the sensed signal is processed by the control unit 126 in the downhole tool 282, and the timer 120 is started. As previously noted, the timer 120 may be set to zero if immediate degradation of the downhole tool 282 is desired upon detection of the electromagnetic wave 280, or the electrical circuit 116 may be closed by the start signal from the control unit 126 when the timer 120 is not included. In another embodiment, the electromagnetic wave 280 is generated from a bottom hole assembly (in this case downhole tool 282) to treat a next zone, such as where downhole tool 284 (which includes any of the features of the downhole tool 110) is located. In yet another embodiment, the electromagnetic wave 280 may be propagated from on-going operations in a neighboring borehole 19. While the borehole 19 is illustrated as a lateral bore in a multilateral completion, the neighboring borehole 19 may alternatively be a well not connected to the borehole 17.

In any of the above-described embodiments, the timer 120 may be set at surface 18 or an alternative location with an initial preset value, but then the triggering time (the time when the circuit 116 is closed) may be delayed or changed by sending a time-changing signal that is detected by the sensor 124, such as, but not limited to, the mud pulse 274, which is processed by the control unit 126 to change the time period for igniter initiation. In an alternative embodiment, the timer 120 may be started at surface 18, but then the time period is altered while the downhole tool 110 is downhole by sending the time-changing signal that is detected by the sensor 124, such as, but not limited to, the mud pulse 274.

Figure 13A:
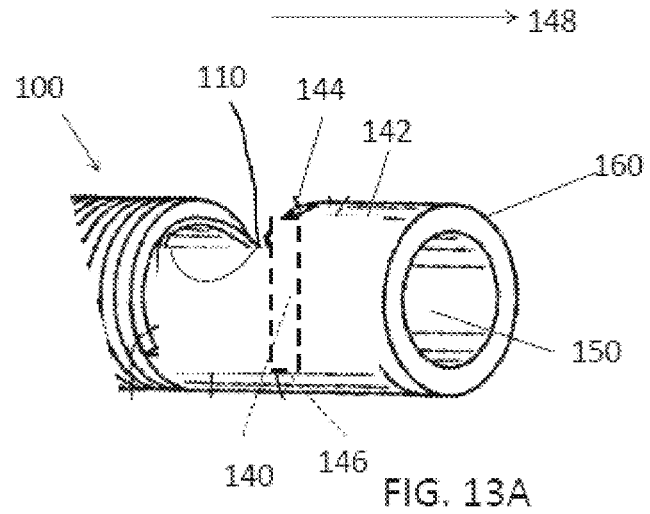
FIG. 13A illustrates the flapper in a closed condition.
Figure 13B:
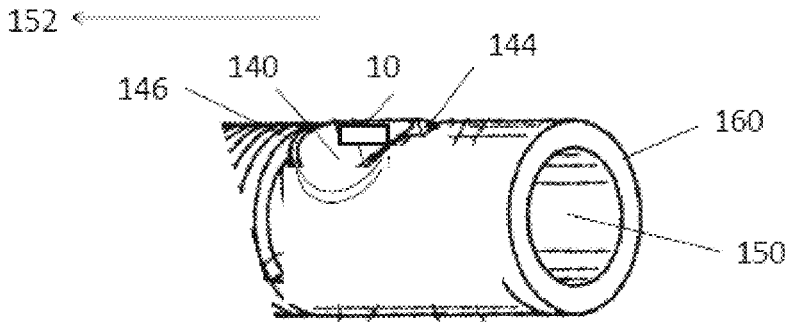
FIG. 13B illustrates the flapper in an open condition.

FIGS. 13A and 13B depict embodiments of the downhole assembly 100 where the downhole tool 110 is a fluid loss control valve 160 having a flapper 140. Flapper 140 is a plate-like member that is pivotally affixed at hinge 144 to one side of tubing string 142 and may be rotated 90 degrees between a closed position (FIG. 13A) where fluid flow is blocked through flowbore 150 in at least the downhole direction 148, and an open position (FIG. 13B) where fluid flow is permitted through flowbore 150. A spring member may be used to bias the flapper 140 toward its closed position, and the flapper 140 may, in some embodiments, be opened using hydraulic fluid pressure. When the flapper 140 is incorporated into a fluid loss control valve 160 and wellbore isolation valve, the flapper 140 may be installed so that the flapper 140 must open by being pivoted upwardly (toward the opening of the well). As illustrated, a free end 146 of the flapper 140 is pivotally movable in a downhole direction 148 to close the flowbore 150 and the free end 146 is pivotally movable in an uphole direction 152 to open the flowbore 150. Conventionally, permanent removal of a fluid loss control valve flapper may be accomplished by breaking the flapper into fragments using mechanical force or hydraulic pressure, however an additional intervention trip would be required and broken pieces remaining in the well could pose potential problems. Thus, the flapper 140 includes the degradable-on-demand material. The degradable-on-demand material can be triggered or actuated remotely on a customer command (such as by using communication line 10 shown in FIG. 5) to degrade, and more particularly to disintegrate and disappear. The triggering signal may be electric current, or alternatively pressure pulse, high energy beam, as well as any of the other above-described embodiments. The degradable-on-demand material used to build the flapper 140 is a composite including at least the dissolvable or non-dissolvable matrix (such as the previously described matrix) and the energetic material (such as any of energetic material 24, 34, 44). The flapper 140 further includes a trigger, such as igniter 114 (FIG. 13B), although in another embodiment, the igniter 114 may be attached to the flapper 140 as opposed to embedded therein. The igniter 114 is arranged to directly engage with at least one starting point of the energetic material, or directly engage with an ignitable material that is directly engaged with the at least one starting point of the energetic material. The matrix provides the structural strength for pressure and temperature rating of the flapper 140. The energetic material once triggered provides the energy to degrade, and more particularly to disintegrate the flapper 140, and the trigger functions as receiver for receiving an on-command (or pre-set) signal and starting the disintegration of the flapper 140. Signal can be sent remotely from the surface 18 of the well and at a selected time by the customer. The flapper 140 can alternatively include the triggering system 112 (FIG. 7A) where the timer 120 to trigger the degradation, inclusive of partial or full disintegration, of the flapper 140 is started when the sensor 124 senses an event or parameter within the borehole, or, in embodiments not including the timer 120, the control unit 126 sends the start signal (in response to a sensed signal reaching a threshold value or otherwise in response to a sensed signal that indicates the occurrence of a target event or parameter) to the electrical circuit 116 to close the electrical circuit 116 and activate the igniter 114. Also, while the flapper 140 has been described for use in a fluid loss control valve 160, the flapper 140 having the degradable-on-demand material may be utilized by other downhole assemblies.

The sensor 124 in any of the above-described embodiments may alternatively or additionally be configured to sense a chemical or electrochemical signal, or electromagnetic tag. As shown in FIGS. 10 and 11, a chemical or electrochemical element 300 or electromagnetic tag 302 may, in one embodiment, be delivered to the downhole tool 110 with frac fluid 264, proppant, or completion fluid, or by alternate fluids and delivery methods for the purpose of being detected by the sensor 124 in triggering system 112. The chemical or electrochemical element 300 or electromagnetic tag 302 could be delivered from surface 18 through the flowbore 150, or delivered by a chemical injection assembly (not shown). The control unit 126 will receive the sensed signals from the sensor 124, and upon the occurrence of the target event or parameter, such as an indication of the presence of the chemical or electrochemical element 300 or electromagnetic tag 302, the control unit 126 will send the start signal to the electrical circuit 116, to either close the electrical circuit 116 or to start the timer 120.

Further, while frac plugs and flappers have been particularly described, the above-described downhole articles may also take advantage of the methods of degrading downhole tools described herein.

Thus, embodiments have been described herein where the triggering system 112 is controlled in response to a signal indicative of a target event or parameter. The target event or parameter can occur downhole, such as in the employment of a perforation gun, the sensing of a pressure differential downhole, or signals from an adjacent downhole tool. The target event or parameter can also include a signal that is sent from surface, such as in a mud pulse or chemical, electrochemical, or electromagnetic tag that is carried with fluid from surface, which can thus incorporate wireless methods for creating the target event or parameter. Further, the control unit 126 can be configured to send the start signal to the electrical circuit after occurrence of any one or more of the signals indicative of a target event or parameter.

Various embodiments of the disclosure include a downhole assembly having a downhole article that includes a matrix material; an energetic material configured to generate energy upon activation to facilitate the disintegration of the downhole article; and a sensor. In any prior embodiment or combination of embodiments, the sensor is operative to receive and process a signal to activate the energetic material, to determine a parameter change to trigger the activation of the energetic material, to monitor a parameter of the downhole article, the downhole assembly, a well condition, or a combination comprising at least one of the foregoing. In any prior embodiment or combination of embodiments, the sensor is configured to monitor the disintegration status of the downhole article. In any prior embodiment or combination of embodiments, the energetic material includes interconnected continuous fibers, wires, foils, or a combination comprising at least one of the foregoing. In any prior embodiment or combination of embodiments, the energetic material includes continuous fibers, wires, or foils, or a combination comprising at least one of the foregoing, which form a three dimensional network; and the matrix material is distributed throughout the three dimensional network. In any prior embodiment or combination of embodiments, the energetic material is randomly distributed in the matrix material in the form of particles, pellets, short fibers, or a combination comprising at least one of the foregoing. In any prior embodiment or combination of embodiments, the downhole article includes an inner portion and an outer portion disposed of the inner portion, the inner portion comprising a core material that is corrodible in a downhole fluid; and the outer portion comprising the matrix material and the energetic material. In any prior embodiment or combination of embodiments, the downhole article includes an inner portion and an outer portion disposed of the inner portion, the inner portion including a core material that is corrodible in a downhole fluid; and the outer portion having a layered structure comprising one or more energetic material layers and one or more matrix material layers. In any prior embodiment or combination of embodiments, the sensor is disposed in the inner portion of the downhole article, the outer portion of the downhole article, or both. In any prior embodiment or combination of embodiments, the core material and the matrix material are selected such that the core material has a higher corrosion rate than the matrix material when tested under the same conditions. In any prior embodiment or combination of embodiments, the inner portion is encased within the outer portion. In an embodiment, the matrix material includes one or more of the following: a polymer; a metal; or a composite. In any prior embodiment or combination of embodiments, the matrix material is not corrodible in a downhole fluid. In any prior embodiment or combination of embodiments, the matrix material is corrodible in a downhole fluid. In any prior embodiment or combination of embodiments, the matrix material includes Zn, Mg, Al, Mn, an alloy thereof, or a combination comprising at least one of the foregoing. In any prior embodiment or combination of embodiments, the matrix material further includes Ni, W, Mo, Cu, Fe, Cr, Co, an alloy thereof, or a combination comprising at least one of the foregoing. In any prior embodiment or combination of embodiments, the energetic material includes a thermite, a reactive multi-layer foil, an energetic polymer, or a combination comprising at least one of the foregoing. In any prior embodiment or combination of embodiments, the thermite includes a reducing agent including aluminum, magnesium, calcium, titanium, zinc, silicon, boron, and a combination comprising at least one of the foregoing reducing agent, and an oxidizing agent comprising boron oxide, silicon oxide, chromium oxide, manganese oxide, iron oxide, copper oxide, lead oxide, and a combination comprising at least one of the foregoing oxidizing agent. In any prior embodiment or combination of embodiments, the energetic polymer includes a polymer with azide, nitro, nitrate, nitroso, nitramine, oxetane, triazole, tetrazole containing groups, or a combination comprising at least one of the foregoing. In any prior embodiment or combination of embodiments, the reactive multi-layer foil comprises aluminum layers and nickel layers or the reactive multi-layer foil comprises titanium layers and boron carbide layers. In any prior embodiment or combination of embodiments, the energetic material is present in an amount of about 0.5 wt. % to about 45 wt. % based on the total weight of the downhole article. In any prior embodiment or combination of embodiments, the sensor includes a sensor material, a sensor element, or a combination comprising at least one of the foregoing.

Various embodiments of the disclosure further include a method of controllably removing a disintegrable downhole article, the method including: disposing the downhole article in a downhole environment, the downhole article including a matrix material, an energetic material configured to generate energy upon activation to facilitate the disintegration of the downhole article, and a sensor; performing a downhole operation; activating the energetic material; and disintegrating the downhole article. In any prior embodiment or combination of embodiments, the method further includes determining a parameter of the downhole article, a downhole assembly comprising the downhole article, the downhole environment, or a combination comprising at least one of the foregoing. In any prior embodiment or combination of embodiments, the parameter includes disintegration status of the downhole article, position of the downhole article, position of the downhole assembly, pressure or temperature of the downhole environment, flow rate of produced water, or a combination comprising at least one of the foregoing. In any prior embodiment or combination of embodiments, activating the energetic material includes providing a command signal to the downhole article, the command signal comprising electric current, electromagnetic radiation, laser beam, mud pulse, hydraulic pressure, mechanical force, or a combination comprising at least one of the foregoing. In any prior embodiment or combination of embodiments, the method further includes detecting a pressure, stress, or mechanical force applied to the downhole article to generate a detected value; comparing the detected value with a threshold value; and generating an electrical charge to activate the energetic material once the detected value exceeds the threshold value. In any prior embodiment or combination of embodiments, activating the energetic material further includes initiating a reaction of the energetic material to generate heat.

Set forth below are various additional embodiments of the disclosure.

Embodiment 1

A downhole assembly arranged within a borehole includes a downhole tool including a degradable-on-demand material, the degradable-on-demand material including: a matrix material; and, an energetic material configured to generate energy upon activation to facilitate the degradation of the downhole tool; and, a triggering system including: an electrical circuit; an igniter in the electrical circuit arranged to ignite the energetic material; a sensor configured to sense a target event or parameter within the borehole; and, a control unit arranged to receive sensed signals from the sensor and to deliver a start signal to the electrical circuit in response to the sensed signals indicating an occurrence of the target event or parameter; wherein, after the start signal is delivered from the control unit, the electrical circuit is closed and the igniter is initiated.

Embodiment 2

The downhole assembly as in any prior embodiment or combination of embodiments, wherein the electrical circuit further includes a timer, the control unit arranged to deliver the start signal to the timer, wherein, when a predetermined time period set in the timer has elapsed, the electrical circuit is closed.

Embodiment 3

The downhole assembly as in any prior embodiment or combination of embodiments, wherein in an open condition of the electrical circuit the igniter is inactive, and in a closed condition of the electrical circuit the igniter is activated, and the timer is operable to close the electrical circuit at an end of the predetermined time period.

Embodiment 4

The downhole assembly as in any prior embodiment or combination of embodiments, wherein the electrical circuit further includes a battery, the battery arranged to provide electric current to set off the igniter in the closed condition of the circuit.

Embodiment 5

The downhole assembly as in any prior embodiment or combination of embodiments, further comprising a perforation gun, wherein the sensor is configured to sense a shock wave that results from firing the perforation gun.

Embodiment 6

The downhole assembly as in any prior embodiment or combination of embodiments, wherein the sensor is configured to detect a pressure differential between an uphole area and a downhole area with respect to the downhole tool, and the event is related to the threshold value of the pressure differential.

Embodiment 7

The downhole assembly as in any prior embodiment or combination of embodiments, wherein the downhole tool includes a body having a piston chamber in fluidic communication with both the uphole area and the downhole area, and a piston configured to move in a downhole direction within the piston chamber when the threshold value of the pressure differential is reached.

Embodiment 8

The downhole assembly as in any prior embodiment or combination of embodiments, wherein the downhole tool further includes a vibratory element sensitive to a fluidic event, the sensor configured to detect vibrations of the vibratory element.

Embodiment 9

The downhole assembly as in any prior embodiment or combination of embodiments, wherein the vibratory element includes at least one of a reed and a caged ball configured to vibrate within fluid flow within a flowbore of the downhole assembly.

Embodiment 10

The downhole assembly as in any prior embodiment or combination of embodiments, wherein the sensor is configured to detect a mud pulse.

Embodiment 11

The downhole assembly as in any prior embodiment or combination of embodiments, wherein the sensor is configured to detect an electromagnetic wave.

Embodiment 12

The downhole assembly as in any prior embodiment or combination of embodiments, wherein the sensor is configured to detect at least one of a chemical element, an electrochemical element, and an electromagnetic tag.

Embodiment 13

The downhole assembly as in any prior embodiment or combination of embodiments, wherein the downhole tool is a frac plug configured to receive a frac ball.

Embodiment 14

The downhole assembly as in any prior embodiment or combination of embodiments, wherein a first component of the frac plug is formed of the degradable-on-demand material, and a second component of the frac plug is formed of the matrix material, the second component not including the energetic material, and the second component in contact with the first component.

Embodiment 15

The downhole assembly as in any prior embodiment or combination of embodiments, wherein the downhole tool is a flapper.

Embodiment 16

The downhole assembly as in any prior embodiment or combination of embodiments, wherein the sensor is a plurality of sensors, and the degradable-on-demand material further includes the plurality of the sensors dispersed therein.

Embodiment 17

The downhole assembly as in any prior embodiment or combination of embodiments, wherein the sensor is a first sensor and the event or parameter within the borehole is a first event or first parameter, and the degradable material includes one or more second sensors within the degradable material configured to detect a second event or second parameter of the downhole tool, the downhole assembly, a well condition, or a combination comprising at least one of the foregoing, and the second event or second parameter is different than the first event or first parameter.

Embodiment 18

The downhole assembly as in any prior embodiment or combination of embodiments, wherein the energetic material comprises continuous fibers, wires, or foils, or a combination comprising at least one of the foregoing, which form a three dimensional network; and the matrix material is distributed throughout the three dimensional network.

Embodiment 19

The downhole assembly as in any prior embodiment or combination of embodiments, wherein the matrix material has a cellular nanomatrix, a plurality of dispersed particles dispersed in the cellular nanomatrix, and a solid-state bond layer extending through the cellular nanomatrix between the dispersed particles.

Embodiment 20

A method of controllably removing a downhole tool of a downhole assembly, the downhole tool including a degradable-on-demand material having a matrix material and an energetic material configured to generate energy upon activation to facilitate the degradation of the downhole tool; and, a triggering system including: an electrical circuit; an igniter in the electrical circuit arranged to ignite the energetic material; a sensor configured to sense a target event or parameter within the borehole; and, a control unit arranged to receive sensed signals from the sensor and to deliver a start signal to the electrical circuit in response to the sensed signals indicating an occurrence of the target event or parameter; the method including disposing the downhole assembly in a downhole environment; sensing a downhole event or parameter with the sensor, the sensor sending sensed signals to the control unit; comparing the sensed signals to a target value, and when the target value is reached, sending the start signal to the electrical circuit; closing the electrical circuit after the start signal is sent; initiating the igniter when the electrical circuit is closed; activating the energetic material using the igniter; and degrading the downhole tool.

Embodiment 21

The method as in any prior embodiment or combination of embodiments, wherein the electrical circuit further includes a timer, the control unit arranged to deliver the start signal to the timer, and initiating the igniter when a predetermined time period set in the timer has elapsed.

Embodiment 22

The method as in any prior embodiment or combination of embodiments, wherein the predetermined time period is zero, and the igniter is initiated substantially simultaneously when the start signal is delivered to the timer.

Embodiment 23

The method as in any prior embodiment or combination of embodiments, further comprising sending a time-changing signal to be sensed by the sensor, and changing the predetermined time period in response to the time-changing signal.

Embodiment 24

The method as in any prior embodiment or combination of embodiments, further comprising firing a perforating gun, wherein sensing the downhole event or parameter with the sensor includes sensing a shock wave that results from firing the perforating gun.

Embodiment 25

The method as in any prior embodiment or combination of embodiments, further comprising increasing fluid pressure uphole of the downhole tool, wherein sensing the downhole event or parameter with the sensor includes at least one of sensing fluid pressure uphole of the downhole tool, sensing a pressure differential between an uphole area and a downhole area with respect to the downhole tool, and sensing vibration of a vibratory element within the uphole area.

Embodiment 26

The method as in any prior embodiment or combination of embodiments, wherein sensing the downhole event or parameter with the sensor includes one or more of detecting frequencies of an electromagnetic wave and sensing a chemical or electrochemical element or electromagnetic tag.

Embodiment 27

The method as in any prior embodiment or combination of embodiments, wherein the sensor is formed within the degradable-on-demand material.

Embodiment 28

The method as in any prior embodiment or combination of embodiments, wherein the sensor is a first sensor and the event or parameter within the borehole is a first event or first parameter, and the degradable-on-demand material includes one or more second sensors within the degradable-on-demand material configured to detect a second event or second parameter of the downhole tool, the downhole assembly, a well condition, or a combination comprising at least one of the foregoing, and the second event or second parameter is different than the first event or first parameter.

Embodiment 29

The method as in any prior embodiment or combination of embodiments, wherein the target event or parameter includes a signal sent from an adjacent downhole tool.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity). Further, it should further be noted that the terms "first," "second," and the like herein do not denote any order, quantity, or importance, but rather are used to distinguish one element from another.

The teachings of the present disclosure apply to downhole assemblies and downhole tools that may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole assembly arranged within a borehole, the downhole assembly comprising:

a downhole tool including a degradable-on-demand material, the degradable-on-demand material including:

a matrix material; and, an energetic material configured to generate energy upon activation to facilitate the degradation of the downhole tool; and, a triggering system including:

an electrical circuit;

an igniter in the electrical circuit arranged to ignite the energetic material;

a sensor configured to sense a target event or parameter within the borehole; and, a control unit arranged to receive sensed signals from the sensor and to deliver a start signal to the electrical circuit in response to the sensed signals indicating an occurrence of the target event or parameter;

wherein, after the start signal is delivered from the control unit, the electrical circuit is closed and the igniter is initiated.

2. The downhole assembly of claim 1, wherein the electrical circuit further includes a timer, the control unit arranged to deliver the start signal to the timer, wherein, when a predetermined time period set in the timer has elapsed, the electrical circuit is closed.

3. The downhole assembly of claim 2, wherein in an open condition of the electrical circuit the igniter is inactive, and in a closed condition of the electrical circuit the igniter is activated, and the timer is operable to close the electrical circuit at an end of the predetermined time period.

4. The downhole assembly of claim 3, wherein the electrical circuit further includes a battery, the battery arranged to provide electric current to set off the igniter in the closed condition of the circuit.

5. The downhole assembly of claim 1, further comprising a perforation gun, wherein the sensor is configured to sense a shock wave that results from firing the perforation gun.

6. The downhole assembly of claim 1, wherein the sensor is configured to detect a pressure differential between an uphole area and a downhole area with respect to the downhole tool, and the event is related to the threshold value of the pressure differential.

7. The downhole assembly of claim 6, wherein the downhole tool includes a body having a piston chamber in fluidic communication with both the uphole area and the downhole area, and a piston configured to move in a downhole direction within the piston chamber when the threshold value of the pressure differential is reached.

8. The downhole assembly of claim 1, wherein the downhole tool further includes a vibratory element sensitive to a fluidic event, the sensor configured to detect vibrations of the vibratory element.

9. The downhole assembly of claim 8, wherein the vibratory element includes at least one of a reed and a caged ball configured to vibrate within fluid flow within a flowbore of the downhole assembly.

10. The downhole assembly of claim 1, wherein the sensor is configured to detect a mud pulse.

11. The downhole assembly of claim 1, wherein the sensor is configured to detect an electromagnetic wave.

12. The downhole assembly of claim 1, wherein the sensor is configured to detect at least one of a chemical element, an electrochemical element, and an electromagnetic tag.

13. The downhole assembly of claim 1, wherein the downhole tool is a frac plug configured to receive a frac ball.

14. The downhole assembly of claim 13, wherein a first component of the frac plug is formed of the degradable-on-demand material, and a second component of the frac plug is formed of the matrix material, the second component not including the energetic material, and the second component in contact with the first component.

15. The downhole assembly of claim 1, wherein the downhole tool is a flapper.

16. The downhole assembly of claim 1, wherein the sensor is a plurality of sensors, and the degradable-on-demand material further includes the plurality of the sensors dispersed therein.

17. The downhole assembly of claim 1, wherein the sensor is a first sensor and the event or parameter within the borehole is a first event or first parameter, and the degradable material includes one or more second sensors within the degradable material configured to detect a second event or second parameter of the downhole tool, the downhole assembly, a well condition, or a combination comprising at least one of the foregoing, and the second event or second parameter is different than the first event or first parameter.

18. The downhole assembly of claim 1, wherein the energetic material comprises continuous fibers, wires, or foils, or a combination comprising at least one of the foregoing, which form a three dimensional network; and the matrix material is distributed throughout the three dimensional network.

19. The downhole assembly of claim 18, wherein the matrix material has a cellular nanomatrix, a plurality of dispersed particles dispersed in the cellular nanomatrix, and a solid-state bond layer extending through the cellular nanomatrix between the dispersed particles.

20. A method of controllably removing a downhole tool of a downhole assembly, the downhole tool including a degradable-on-demand material having a matrix material and an energetic material configured to generate energy upon activation to facilitate the degradation of the downhole tool; and, a triggering system including: an electrical circuit; an igniter in the electrical circuit arranged to ignite the energetic material; a sensor configured to sense a target event or parameter within the borehole; and, a control unit arranged to receive sensed signals from the sensor and to deliver a start signal to the electrical circuit in response to the sensed signals indicating an occurrence of the target event or parameter; the method comprising:

disposing the downhole assembly in a downhole environment;

sensing a downhole event or parameter with the sensor, the sensor sending sensed signals to the control unit;

comparing the sensed signals to a target value, and when the target value is reached, sending the start signal to the electrical circuit;

closing the electrical circuit after the start signal is sent;

initiating the igniter when the electrical circuit is closed;

activating the energetic material using the igniter; and degrading the downhole tool.

21. The method of claim 20, wherein the electrical circuit further includes a timer, the control unit arranged to deliver the start signal to the timer, and initiating the igniter when a predetermined time period set in the timer has elapsed.

22. The method of claim 21, wherein the predetermined time period is zero, and the igniter is initiated substantially simultaneously when the start signal is delivered to the timer.

23. The method of claim 21, further comprising sending a time-changing signal to be sensed by the sensor, and changing the predetermined time period in response to the time-changing signal.

24. The method of claim 20, further comprising firing a perforating gun, wherein sensing the downhole event or parameter with the sensor includes sensing a shock wave that results from firing the perforating gun.

25. The method of claim 20, further comprising increasing fluid pressure uphole of the downhole tool, wherein sensing the downhole event or parameter with the sensor includes at least one of sensing fluid pressure uphole of the downhole tool, sensing a pressure differential between an uphole area and a downhole area with respect to the downhole tool, and sensing vibration of a vibratory element within the uphole area.

26. The method of claim 20, wherein sensing the downhole event or parameter with the sensor includes one or more of detecting frequencies of an electromagnetic wave and sensing a chemical or electrochemical element or electromagnetic tag.

27. The method of claim 20, wherein the sensor is formed within the degradable-on-demand material.

28. The method of claim 20, wherein the sensor is a first sensor and the event or parameter within the borehole is a first event or first parameter, and the degradable-on-demand material includes one or more second sensors within the degradable-on-demand material configured to detect a second event or second parameter of the downhole tool, the downhole assembly, a well condition, or a combination comprising at least one of the foregoing, and the second event or second parameter is different than the first event or first parameter.

29. The method of claim 20, wherein the target event or parameter includes a signal sent from an adjacent downhole tool.

* * * * *